US006361152B1

(12) United States Patent
Fujisawa

(10) Patent No.: US 6,361,152 B1
(45) Date of Patent: Mar. 26, 2002

(54) INK JET HEAD AND METHOD OF FABRICATION THEREOF

(75) Inventor: Junichi Fujisawa, Niigata (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/311,536

(22) Filed: May 13, 1999

(30) Foreign Application Priority Data

May 14, 1998 (JP) ..... 10-131899

(51) Int. Cl.[7] ..... B41J 2/045
(52) U.S. Cl. ..... 347/68
(58) Field of Search ..... 347/68, 54, 69, 347/70, 71, 72, 50, 40; 399/261; 361/700; 29/890.1; 310/328–330

(56) References Cited

U.S. PATENT DOCUMENTS 5,539,982 A 7/1996 Hosono et al.

FOREIGN PATENT DOCUMENTS

| | | |
|---|---|---|
| EP | 0641073 | 3/1995 |
| JP | 62-212159 | 9/1987 |
| JP | 7-9682 | 1/1995 |
| JP | 8-1932 | 1/1996 |
| JP | 8-11304 | 1/1996 |
| JP | 9-1796 | 1/1997 |
| JP | 10-58684 | 3/1998 |
| WO | 95/04658 | 2/1995 |

OTHER PUBLICATIONS

European Search Report (in English) issued Oct. 12, 1999 in a related application.

Patent Abstracts of Japan, vol. 010, No. 054 (E–385), Mar. 4, 1986 & JP 60 206214 A (Toshiba KK), Oct. 17 1985 *abstract*.

Patent Abstracts of Japan, vol. 199, No. 702, Feb. 28, 1997 & JP 08 258258 A (Seiko Epson Corp), Oct. 8, 1996 *abstract*.

Patent Abstracts of Japan, vol. 018, No. 003 (E–1485), Jan. 6, 1994 & JP 05 244692 A (Matsushita Electric Works Ltd), Sep. 21, 1993 *abstract*.

*Primary Examiner*—Raquel Yvette Gordon
(74) *Attorney, Agent, or Firm*—Ostrolenk, Faber, Gerb & Soffen, LLP

(57) ABSTRACT

An ink jet head having a plurality of drive columns includes a plate having a plurality of diaphragm portions which are bonded to end surfaces of the drive columns with an adhesive, respectively. Each of the diaphragm portions is driven by a drive column corresponding to the diaphragm portion thereby to eject ink droplets. One of the diaphragm portion and the corresponding drive column includes an accommodating groove for accommodating an excess adhesive produced when bonding the diaphragm portion to the end surface of the drive column.

16 Claims, 5 Drawing Sheets

INK JET HEAD AND METHOD OF FABRICATION THEREOF

BACKGROUND OF THE INVENTION

1. Field of the Invention

The present invention relates to an ink jet head used for a recording apparatus and a method of fabrication thereof, and in particular to an ink jet head and a method of fabrication thereof in which so-called crosstalks are prevented which otherwise might occur when ejecting ink droplets.

2. Description of the Related Art

An ink jet head used for an ink jet printer is provided with a plurality of drive columns functioning as a drive mechanism, which are constructed by forming a plurality of groves including those crossing the grooves in a piezoelectric element. Diaphragm portions are bonded with adhesive to the column end surfaces of the respective drive columns. Therefore, the drive columns selectively drive the diaphragm portions to eject ink droplets from the selected nozzles.

Such an ink jet head is required to have a high ejection efficiency in order to achieve a high image quality. For meeting this requirement, it is important to bond the diaphragm portions to the end surfaces of the drive columns closely without any gap.

In the prior art, when bonding the end surfaces of the drive columns formed on a piezoelectric element and the diaphragm portions to each other, a gap agent is filled in the gaps formed between the end surfaces and the diaphragms or the amount of the adhesive applied is increased in order to prevent the gaps from forming.

According to Japanese Unexamined Patent Publication No. 8-1932 entitled "An ink jet head and a method of fabrication thereof", the bonding surface of the piezoelectric element (the end surfaces of the drive columns) are positioned to protrude from the bonding surface of a frame for fixing the piezoelectric element thereby to improve the closeness between the diaphragm portions and the piezoelectric element for an improved ejection efficiency. The technique described in this publication No. 8-1932, in which the diaphragm portions are bonded while being slightly pressed, has produced some effect as far as it improves the closeness.

In the apparatus and the method disclosed in the patent publication No. 8-1932, however, the bonding surfaces of the drive columns (drive end surfaces) to which the diaphragm portions are bonded are flat in shape. The problem is posed, therefore, that the adhesive leaks out and attaches to adjacent drive columns at the time of bonding and crosstalks are liable to be caused when ejecting ink droplets. This problem has become more serious as the pitch of the drive columns of the piezoelectric elements has been increasingly shortened with the increase in the degree of integration.

SUMMARY OF THE INVENTION

An object of the present invention is to provide an ink jet head, which can achieve reliable ejection of ink droplets.

Another object of the present invention is to provide an ink jet head having a structure in which the adhesive that has leaked out at the time of bonding is prevented from attaching to adjacent drive columns and method of fabrication of such an ink jet head.

According to an aspect of the present invention, an ink jet head includes a plurality of drive columns arranged in parallel, each of the drive columns comprising a piezoelectric member; and a plate having a plurality of diaphragm portions which are bonded to end surfaces of the drive columns with an adhesive, respectively. Each of the diaphragm portions is driven by a drive column corresponding to the diaphragm portion thereby to eject ink droplets. At least one of each of the diaphragm portions and the drive column corresponding the diaphragm portion comprises an accommodating groove for accommodating an excess adhesive produced when bonding the diaphragm portion to the end surface of the drive column.

Each of the drive columns may comprise the accommodating groove. The accommodating groove is preferably a rack portion formed one step lower than the end surface of the drive column along a peripheral edge of an end portion of the drive column. The rack portion may be formed along the entire peripheral edge of the end portion. The accommodating groove may be a recess formed in the end surface of the drive column. Alternatively, each of the diaphragm portions may include the accommodating groove. The accommodating groove may be a recess formed in the diaphragm portion.

According to another aspect of the present invention, a method of fabricating an ink jet head, includes the steps of: a) forming a plurality of grooves including those crossing said grooves in a piezoelectric element to form a plurality of drive columns; b) forming an accommodating groove in each of the drive columns, wherein the accommodating groove is designed to accommodate an excess adhesive which is produced when bonding the diaphragm portion to the end surface of the drive column; and c) bonding the diaphragm portion to the end surface of the drive column with an adhesive.

In the step a), a cutting tool of a predetermined width may be used to form the grooves to produce the drive columns each shaped like a rectangular solid. In the step b), the cutting tool may be also used to form a rack portion one step lower than the end surface of the drive column along a peripheral edge of an end portion of the drive column to produce the accommodating groove. In this case, the rack portion may be formed by using the cutting tool shifted from a position set in the step a) by a predetermined distance.

Alternately, in the step a), a first cutting tool having a first width may be used to form the grooves to produce the drive columns each shaped like a rectangular solid. In the step b), a second cutting tool having a second width wider than the first width may be used to form opposite rack portions of adjacent drive columns to produce the accommodating groove, wherein a rack portion is formed one step lower than the end surface of the drive column along a peripheral edge of an end portion of the drive column.

As described above, the accommodating groove is formed in the drive column or the diaphragm portion to accommodate an excess adhesive which leaks out at the time of bonding the diaphragm portion and the drive column to each other. Therefore, even in the case where the pitch of the drive columns has been increasingly shortened with the increase in the degree of integration, the excess adhesive is prevented from attaching to the adjacent drive columns and thus causing crosstalks at the time of ink droplet ejection to be effectively suppressed.

DESCRIPTION OF THE PREFERRED EMBODIMENTS

First Embodiment

A first embodiment of the present invention will be described in detail with reference to FIGS. 1–3.

Figure 1:
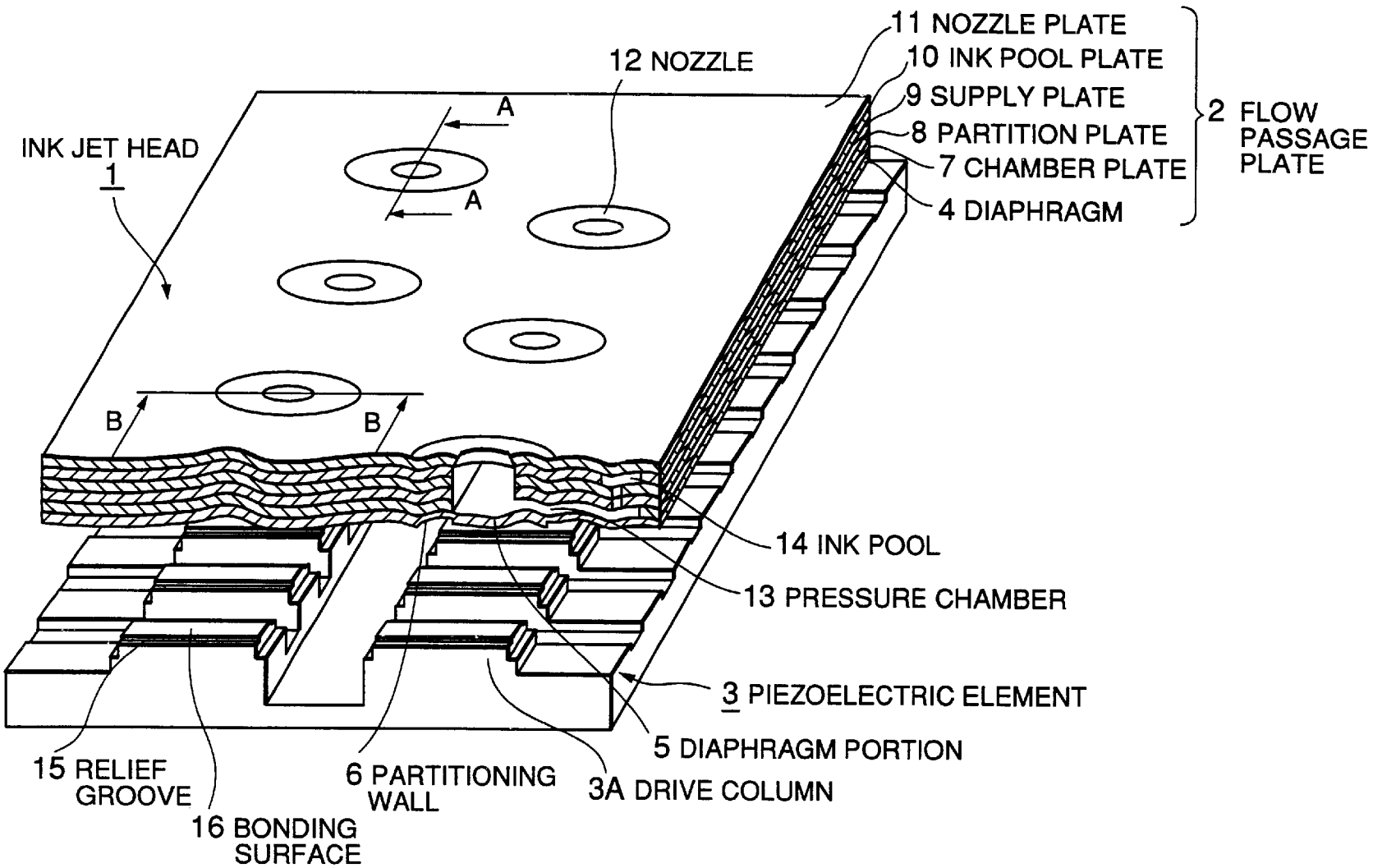
FIG. 1 is a perspective view showing a basic configuration of an ink jet head of piezoelectric type according to a first embodiment of the present invention.

In FIG. 1, an ink jet head 1 comprises a flow passage plate 2 and a piezoelectric element 3 on which the flow passage plate 2 is fixedly mounted. The piezoelectric element 3 has a plurality of drive columns 3A formed in an arrangement. The flow passage plate 2 includes a diaphragm plate 4, a chamber plate 7, a partition plate 8, a supply plate 9, an ink pool plate 10 and a nozzle plate 11 laid in that order from the side of the piezoelectric element 3.

The diaphragm plate 4 is formed with a diaphragm portion 5 and a partitioning wall portion 6 corresponding to each drive column 3A. The diaphragm plate 4 is formed tabular by etching or electroforming SUS, nickel or the like so as to form the diaphragm portion 5. The diaphragm plate 4 may be composed of a resin such as polyimide and a metal member attached to each other, and is formed by etching in such a manner as to leave the metal member in the bonded portion to the piezoelectric element 3.

The chamber plate 7 is formed with a pressure chamber 13. This chamber plate 7 is formed by etching a metal material such as SUS or nickel, using an injection mold member of a resin material, etching an inorganic material such as Si or glass, or using a photosensitive resin material such as dry film.

The partition plate 8 is included in order to improve the rigidity of the flow passage plate 2. This partition plate 8 is formed by etching a metal member such as SUS or nickel.

The ink pool plate 10 is formed with an ink pool 14. The supply plate 9 has the function of supplying the ink from the ink pool 14 to the pressure chamber 13. The supply plate 9 and the ink pool plate 10 are also formed by etching a metal member.

The nozzle plate 11 is formed with nozzles 12. The nozzles 12 of this nozzle plate 11 are required to be micromachined. One method is the press work using a SUS plate as a member and another method is electroforming using a nickel plate. In the case of a resin plate such as polyimide, the nozzles 12 are formed by excimer laser.

The piezoelectric element 3 is formed as a multilayered piezoelectric element segmented at a pitch corresponding to each nozzle pitch. The piezoelectric element 3 is formed of a plurality of grooves including those crossing each other in the upper surface thereof thereby to form the drive columns 3A each corresponding to a piezoelectric element between the grooves.

Further, each drive column 3A is formed with a rack (hereinafter referred to as the relief groove) 15 over the entire peripheral edge of the column end portion thereof. The relief groove 15 is formed at a position about 10 $\mu$m to 50 $\mu$m lower than the bonding surface 16 of the column end portion.

Figure 2:
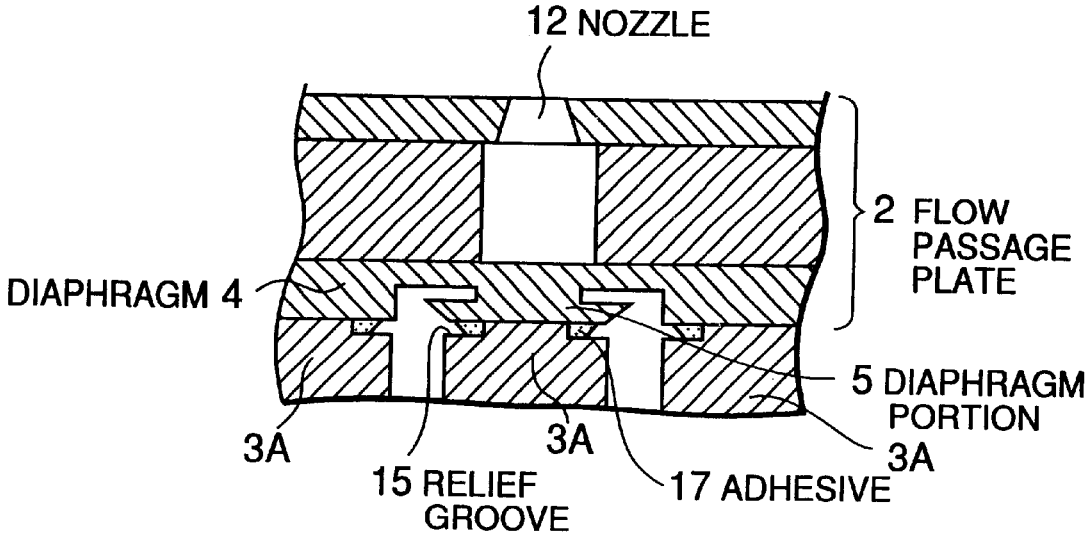
FIG. 2 is a sectional view taken in line A—A in FIG. 1.
Figure 3:
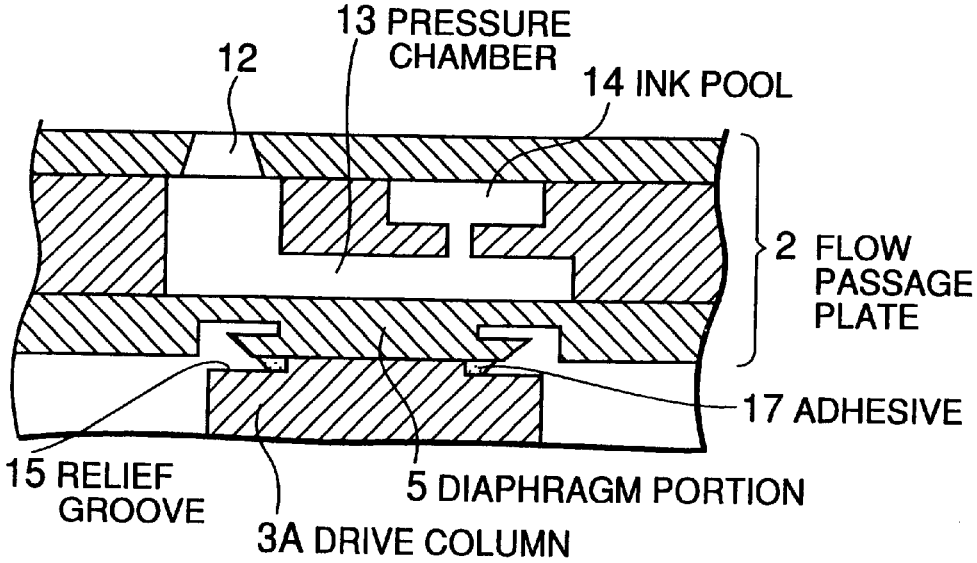
FIG. 3 is a sectional view (a longitudinal sectional view of a pressure chamber) taken in line B—B in FIG. 1.

Now, the flow passage plate 2 and the piezoelectric element 3 are bonded to each other with an adhesive 17 as shown in FIGS. 2 and 3. The formation method will be described hereafter.

First, the adhesive 17 is applied on the bonding surface 16 of each drive column 3A by screen printing or transfer. An epoxy adhesive of two-part room temperature curing type or an epoxy adhesive of thermosetting type is used as the adhesive 17. The adhesive 17 desirably has such a comparatively high post-setting hardness of 80 to 95 (Shore A) that the diaphragm portion 5 follows the motion of the corresponding drive column 3A.

Then, the diaphragm portion 5 of the diaphragm plate 4 is mounted in position on the bonding surfaces 16 of the corresponding drive column 3A and placed on the piezoelectric element 3. Then, the chamber plate 7 is disposed on the upper surface of the diaphragm plate 4. The partition plate 8, the supply plate 9, the ink pool plate 10 and the nozzle plate 11 are laid in that order by being bonded on the upper surface of the chamber plate 7 thereby to form the flow passage plate 2 on the piezoelectric element 3.

Each plate is bonded by a method in which the adhesive is applied on each plate by screen printing or the like, a method in which a photosensitive resin such as the dry film used as a chamber plate material is laminated on each plate and the plates laid one on the other are bonded by being heated under pressure, or a method in which the chamber plate 7, the ink pool plate 10, the supply plate 9 and the partition plate 8 are jointed to each other by thermal diffusion. In the case where the nozzle plate 11 of resin is used, a resin plate can be used on which a thermoplastic or thermosetting adhesive is applied to form a thin film of 3 $\mu$m to 10 $\mu$m in advance. Further, when using a resin plate also for the diaphragm plate 4, a similar bonding method can be used.

The press work causes the diaphragm portion 5 to be closely attached to the bonding surface 16 and firmly fixed by the setting adhesive 17. The adhesive 17 applied and set on the bonding surface 16 forms a film about 3 $\mu$m to 5 $\mu$m thick in the boundary between the bonding surface 16 and the diaphragm portion 5. With the increases in the thickness of the boundary film, the motion of the piezoelectric element 3 might be absorbed depending on the hardness of the adhesive, so that no pressure can be efficiently applied to the diaphragm portion 5. The boundary film, therefore, is desirably as thin as possible.

Next, as an example, how the relief grooves 15 are formed will be described with reference to FIGS. 4 and 5. Here, the drive columns 3A and the relief grooves 15 are machined with a dicing saw used in semiconductor applications.

The piezoelectric element 3 is segmented into the drive columns by the dicing saw and thereafter the relief grooves 15 are cut with a blade 18 applied to the peripheral edge of the drive column 3A. The piezoelectric element 3, which is mounted on the stage of the dicing saw, is both movable along the X and Y axes and rotatable.

Figure 4:
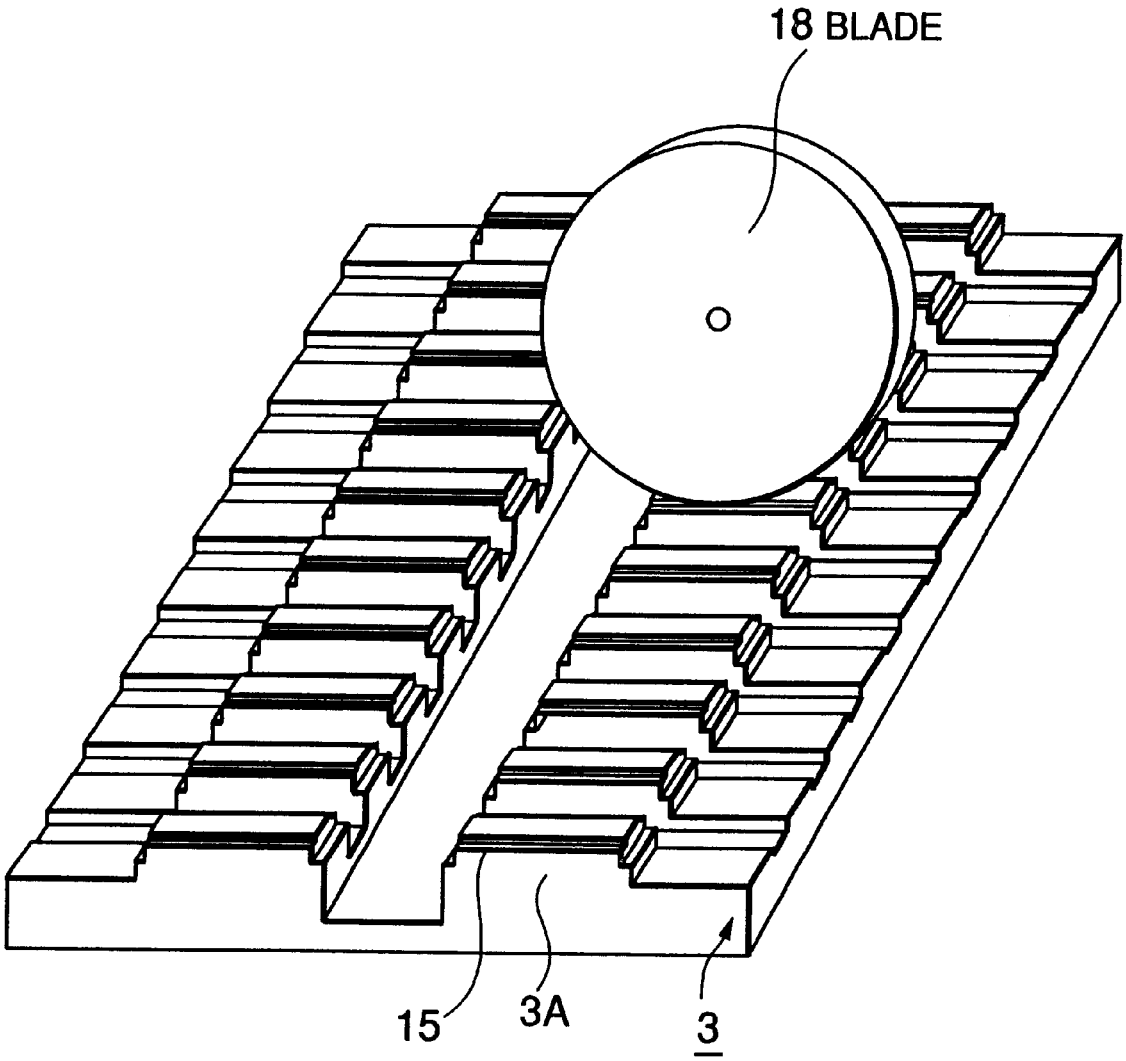
FIG. 4 is a perspective view of an array of drive columns for explaining a method of machining a relief groove (rack portion) of the ink jet head according to the first embodiment.
Figure 5:
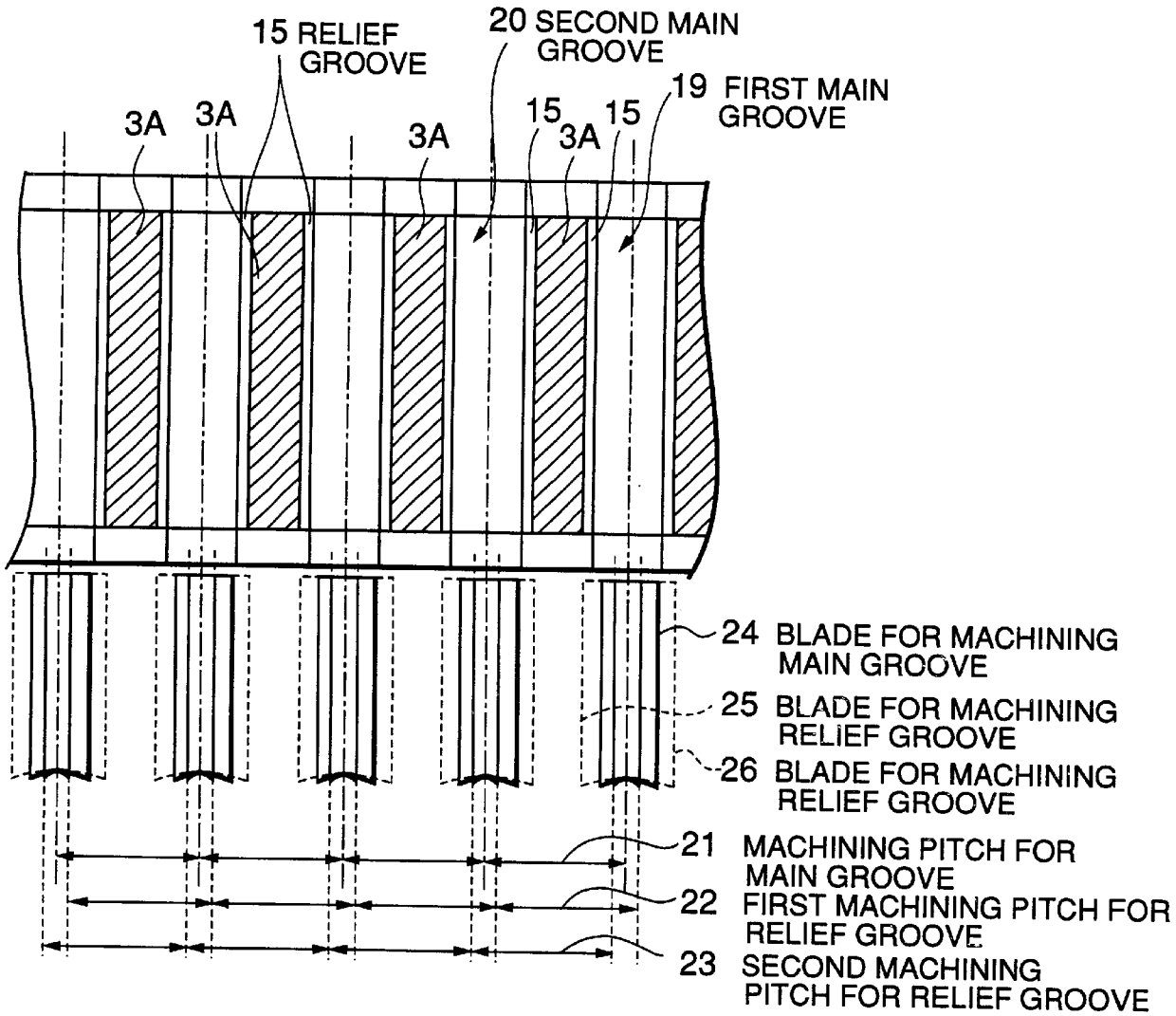
FIG. 5 is a plan view of the array of drive columns for explaining a method of taking measurements used for machining the relief groove (rack portion) for the ink jet head according to the first embodiment.

As shown in FIG. 4, the piezoelectric element 3 is moved in the direction perpendicular to the grooves, and the blade 18 is set to the position of a given groove (the main groove as called in FIG. 5). Under this condition, the piezoelectric element 3 is moved along the groove whereby the side edge of the drive column 3A along the groove is cut by the blade 18.

As shown in FIG. 5, more specifically, each solid line 24 indicates the position of the blade 18 for machining a main groove such as a first main groove 19 and a second main groove 20 formed between adjacent two drive columns. The first main groove 19 and the second main groove 20 are formed at the interval of the machining pitch 21.

In cutting the relief groove 15 in the side edge of a drive column 3A along the main groove using the blade 18 that has machined the main grooves, as shown in FIG. 5, a first machining pitch 22 and a second machining pitch 23 are defined. These pitches, though equal in value, are specifically defined by displacing the machining pitch 21 for the main grooves by ¼ the blade thickness (mm), for example.

The relief grooves 15 are machined in the following manner. The piezoelectric element 3 is moved at the first machining pitch 22 so that the relief grooves 15 are sequentially formed on one-edge sides of the drive columns 3A. Then, the piezoelectric element 3 is moved in reverse direction at the second machining pitch 23 thereby to form the relief grooves 15 sequentially on the other-edge sides of the drive columns.

Once the relief grooves 15 are formed along the main grooves in both edges of each drive column in this way, the piezoelectric element 3 is turned 90° by rotating the dicing saw stage and the blade 18 is thereby set in the direction perpendicular to the main grooves. Then, the piezoelectric element 3 is moved in the direction at right angles to the main grooves to cut the relief grooves 15 along the short sides of each of the drive columns 3A. As a result, the relief grooves 15 are formed along the whole peripheral edge of the end portion of each drive column 3A.

The foregoing description refers to the case of machining the relief grooves 15 with the blade 18 used for machining the main grooves.

Another method of machining the relief grooves 15 may be employed. The relief grooves 15 are machined at the same pitch as the main grooves using a blade thicker than the blade 18 used for machining the main grooves. In this case, the relief grooves 15 along the long sides of the opposite two drive columns 3A for each main groove can be formed at a time. The relief grooves 15 along the short sides of the drive columns 3A, on the other hand, are cut by rotating the piezoelectric element 3 by 90° in the same manner as described above.

The process for machining the relief grooves described above may be executed before machining the main grooves. The entire operation of machining the main grooves and the relief grooves is performed automatically by program control.

In the above process, the adhesive 17 that has leaked out under the pressure flows into the relief groove 15 and is set. As a result, adjacent drive columns are prevented from being mechanically connected with the adhesive 17 leaking out from the end surface of the drive columns. No crosstalks occur, therefore, when ink droplets are ejected with the pressure chamber 13 pressed by the diaphragm portion 5 in accordance with the displacement of the drive columns 3A after a driving voltage based on the print data is applied to the piezoelectric element 3.

Also, the adhesive that has flowed out is prevented from inputting into the gap between the diaphragm portion 5 and the partitioning wall 6. If the adhesive intrudes in the gap, then the vibration of the diaphragm portion 5 would be suppressed, resulting in the reduced ejection efficiency.

Further, an increased amount of the adhesive 17 can be applied for an improved bonding reliability. Also, even when the coating of the adhesive 17 is irregular, the fact that the overflowing adhesive 17 can flow into the relief grooves 15 improves the yield of the ink jet head fabrication.

Second Embodiment

Figure 6:
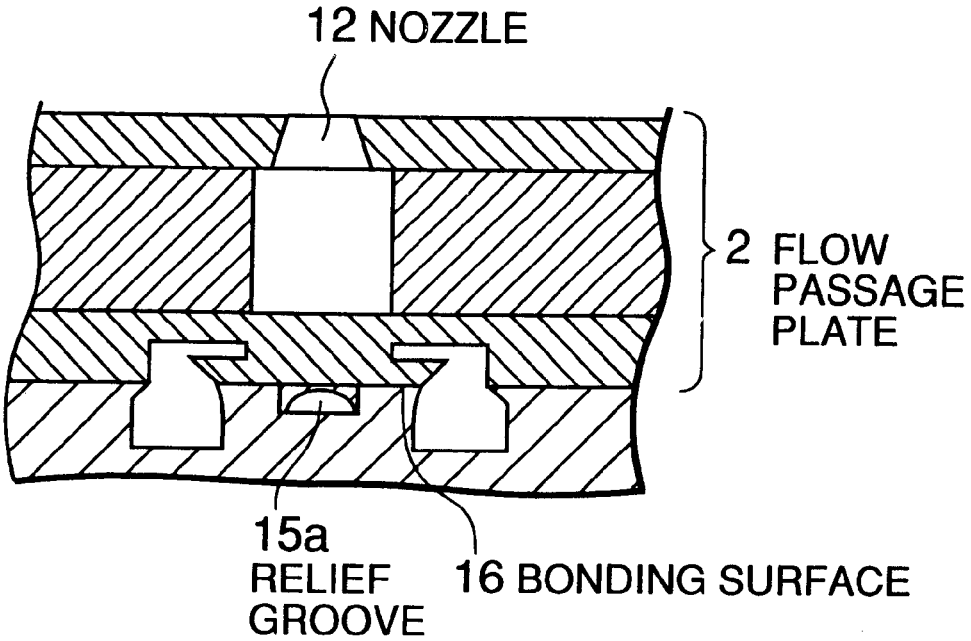
FIG. 6 is a sectional view of the essential parts (sectional view corresponding to the one taken in line A—A in FIG. 1) of an ink jet head of piezoelectric type according to a second embodiment.

Referring to FIG. 6, the rack portions 15 (relief grooves 15) of the first embodiment for accommodating the excess adhesive are replaced by recesses 15*a* (hereinafter referred to as the relief grooves 15*a*) formed in the adhesive surface 16 of the drive column 3A. The relief grooves 15*a,* which may be simple depressions or V grooves, are elongate parallelepipeds formed along the center line halving the short side of the bonding surface 16 into two equal parts.

The relief grooves 15*a* can be machined in any stages before or after machining the main grooves as in the first embodiment. The relief grooves 15*a* shown, however, have the width not more than one half that of the column formed by machining the main grooves. The blade 18 for machining the relief grooves 15*a,* therefore, are required to have such a thickness to be capable of machining a groove not more than one half of the column width.

In this embodiment, the excess adhesive 17 applied on the bonding surface 16 around each of the relief grooves 15*a* flows into the relief grooves 15*a* as the diaphragm portion 5 is bonded with the adhesive surface 16 (shown by hatching in FIG. 6).

Since each relief groove 15*a* is formed in the central portion of the bonding surface 16, the amount of the adhesive flowing out from adjacent drive columns is reduced considerably as compared with the corresponding amount in the prior art. As a result, the adjacent drive columns are not connected with the adhesive thereby making it possible to prevent crosstalks from occurring at the time of ink droplet discharge.

The portion of the relief groove 15*a* shown in FIG. 6 that is not hatched indicates a hollow portion lacking the adhesive formed in the bottom of the relief groove 15*a*. This phenomenon occurs due to the fact that the excess adhesive flows into the relief groove 15*a* while being attracted by the adhesive 17 on the bonding surface 16.

Third Embodiment

Figure 7:
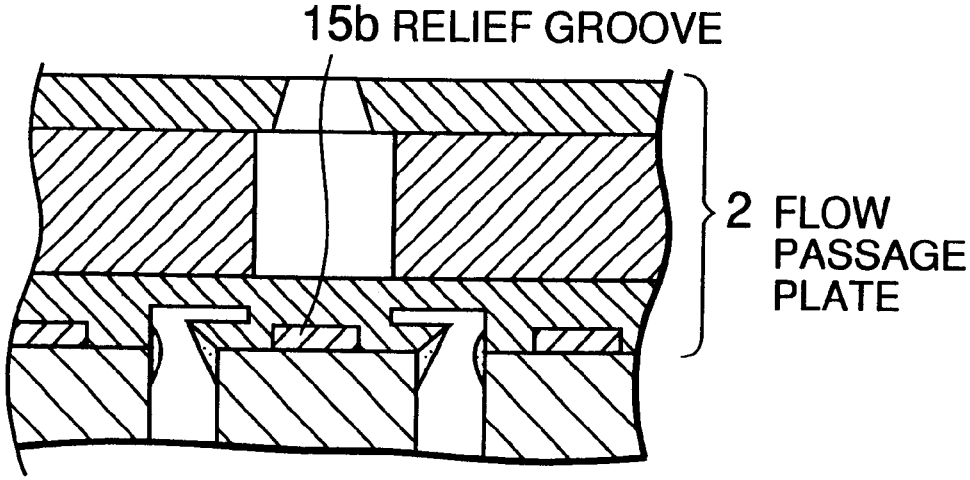
FIG. 7 is a sectional view of the essential parts (sectional view corresponding to the one taken in line A—A in FIG. 1) of an ink jet head of piezoelectric type according to a third embodiment.

Referring to FIG. 7, the relief grooves 15 forming the accommodating means on the drive column 3A are replaced by recesses 15*b* (hereinafter referred to as the relief grooves 15*b*) formed in the diaphragm portion 5 of the diaphragm plate 4 for accommodating the excess adhesive.

The relief groove 15*b* according to the third embodiment is formed by etching or pressing the diaphragm portion 5 of the diaphragm plate 4. The adhesive 17 applied to the bonding surface 16 of the drive column 3A flows into the relief grooves 15*b* under the pressure imparted thereto at the time of bonding the flow passage plate 2 and the piezoelectric element 3 to each other. As a result, the third embodiment has a similar effect to that of the first and second embodiments.

A combination of the first/second embodiment and the third embodiment may be made easily. In other words, the relief grooves 15/15*a* and the relief grooves 15*b* may be formed in the drive columns and the diaphragm portions, respectively.

What is claimed is:

1. An ink jet head comprising:

a plurality of drive columns arranged in parallel, each of the drive columns provided with a respective planar end surface and comprising a piezoelectric member;

a plate having a plurality of diaphragm portions, each of the diaphragm portions having a planar end surface juxtaposed with the planar end surface of a respective drive column;

an adhesion bonding the planar end surfaces such that the two planar surfaces abut one another along a planar abutting area having an edge;

at least one groove formed in at least one of the planar end surfaces and recessed from the planar abutting area along the edge for accommodating excess amounts of adhesive material produced upon bonding.

2. The ink jet head according to claim 1, wherein each planar end surface of the drive columns comprises the respective groove.

3. The ink jet head according to claim 2, wherein the groove is a rack portion formed one step lower than the planar end surface of the drive column.

4. The ink jet head according to claim 3, wherein the rack portion is formed along the entire peripheral edge of the end portion.

5. The ink jet head according to claim 1, wherein the relief groove is a recess formed in the end surface of the drive column.

6. The ink jet head according to claim 1, wherein each planar end surface of the diaphragm portions having width and provided with a central portion, the relief groove being formed in the center portion and having a width smaller than the width of the planar end surface of the diaphragm.

7. The ink jet head according to claim 6, wherein the accommodating groove is a recess formed in the diaphragm portion.

8. A method of fabricating an ink jet head, comprising the steps of:

a) forming a plurality of separating grooves including those crossing said separating grooves in a piezoelectric element to form a plurality of drive columns, each of the drive columns having a planar end surface;

b) forming a relief groove in each of the planar end surfaces of the drive columns; and c) bonding each of the planar end surfaces of the drive columns to a respective planar end surface of a diaphragm portion with an adhesive, thereby forming a planar abutting area between each pair of the bonded planar end surfaces, wherein the relief groove is designed to be recessed from an edge of the planar abutting area to accommodate an excess adhesive which is produced when bonding the diaphragm portion of the drive column.

9. The method according to claim 8, wherein in the step a), a cutting tool of a predetermined width is used to form the grooves to produce the drive columns each shaped like a rectangular solid; and in step b), the cutting tool is also used to form a rack portion one step lower than the planar end surface of the drive column along a peripheral edge of a planar end portion of the drive column to produce the relief groove.

10. The method according to claim 9, wherein the rack portion is formed by using the cutting tool shifted from a position set in the step a) by a predetermined distance.

11. The method according to claim 9, wherein in the step b), the rack portion is formed along the entire peripheral edge of the planar end portion by relatively rotating the piezoelectric element with respect to the cutting tool by an angle of 90 degrees to produce the relief groove.

12. The method according to claim 8, wherein the step a), a first cutting took having a first width is used to form the grooves to produce the drive columns each shaped like a rectangular solid; and in the step b), a second cutting tool having a second width wider than the first width is used to form opposite rack portions of adjacent drive columns to produce the relief groove, wherein a rack portion is formed one step lower than the planar end surface of the drive column along a peripheral edge of the planar end surface of the drive column.

13. The method according to claim 11, wherein in the step b), the rack portion is formed along the entire peripheral edge of the planar end portion by relatively rotating the piezoelectric element with respect to the cutting tool by an angle of 90 degrees to produce the relief groove.

14. An ink jet head comprising:

a drive column having a piezoelectric member and provided with a planar end surface;

an ink diaphragm having a planar end surface;

an adhesive material bonding the planar end surfaces together such that the two planar end surfaces abut one another along a planar abutting area; and at least one groove formed in at least one of the planar end surfaces and recessed from the planar abutting area along an edge thereof.

15. An ink jet head according to claim 14, wherein said planar end surfaces are flat planes.

16. An ink jet head comprising:

a drive column having a piezoelectric member and provided with a planar end surface;

an ink diaphragm having a planar end surface;

an adhesive material bonding the planar end surfaces together such that the two planar end surfaces abut one another along a planar abutting area; and at least one groove formed in at least one of the planar end surfaces within the planar abutting area for receiving excess amounts of the adhesive material.

* * * * *